US007026087B2

(12) United States Patent
Mikuriya et al.

(10) Patent No.: US 7,026,087 B2
(45) Date of Patent: Apr. 11, 2006

(54) TONER COMPOSITION

(75) Inventors: Yoshihiro Mikuriya, Nishinomiya (JP); Masahiro Anno, Hachioji (JP); Katsunori Kurose, Amagasaki (JP); Masahide Inoue, Nara-ken (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 153 days.

(21) Appl. No.: 10/673,471

(22) Filed: Sep. 30, 2003

(65) Prior Publication Data

US 2004/0101775 A1 May 27, 2004

(30) Foreign Application Priority Data

Oct. 9, 2002 (JP) ..... 2002-295998

(51) Int. Cl.
*G03G 9/08* (2006.01)

(52) U.S. Cl. ..... 430/108.4; 430/108.7; 430/108.8; 430/109.4

(58) Field of Classification Search ..... 430/108.4, 430/109.4, 108.8, 108.7
See application file for complete search history.

(56) References Cited

U.S. PATENT DOCUMENTS

| | | | | |
|---|---|---|---|---|
| 5,344,737 | A | 9/1994 | Berkes et al. | |
| 5,368,970 | A | 11/1994 | Grushkin | |
| 5,547,796 | A * | 8/1996 | Kohtaki et al. | 430/110.4 |
| 6,660,443 | B1 * | 12/2003 | Sugiyama et al. | 430/108.4 |

FOREIGN PATENT DOCUMENTS

| | | |
|---|---|---|
| JP | 2001-249485 | 9/2001 |
| JP | 2001-255690 | 9/2001 |

* cited by examiner

*Primary Examiner*—John L Goodrow
(74) *Attorney, Agent, or Firm*—Buchanan Ingersoll PC

(57) ABSTRACT

A toner composition, comprising a binder resin, a wax, a copolymer and a colorant;

the copolymer being a copolymer between an α-olefin, maleic anhydride and maleic anhydride monoester.

22 Claims, 3 Drawing Sheets

TONER COMPOSITION

This application is based on application(s) No.2002-295998 filed in Japan, the contents of which are hereby incorporated by reference.

BACKGROUND OF THE INVENTION

1. Field of the Invention

The present invention relates to a toner used for developing an electrostatic latent image formed by an electrophotographic method, an electrostatic recording method or the like, and more particularly concerns a toner that requires no oil in a fixing device. The present invention also relates to a pulverized-type toner composition made from at least a binder resin in which wax is uniformly dispersed with particles having a comparatively large size, the wax and a wax dispersant.

2. Description of the Related Art

With respect to the conventional toner fixing system, a heat roll system has been widely used. In the heat roll system, a toner image is made in press-contact with the surface of a heat roll in a melt-heated state. Consequently, one portion of the toner image adheres to the heated roll surface, and is transferred thereon, resulting in a problem of stains on the next sheet to be fixed, that is, a so-called offset phenomenon; and, this offset phenomenon needs to be prevented. In this heat roll system, a separation mechanism such as a separation claw or the like is formed in the roll portion so as to prevent a defective separation in which the sheet for toner-fixing such as paper is wound around the roll after passing through the roll portion. However, in the case of an increased stress due to a high printing speed of a copying machine/printer, or in the case of adhesion of toner clumps onto the leading end of the sheet for toner to be fixed, problems of a defective separation and separation claw scratches are raised.

For this reason, a method which improves the toner mold-releasing property in the heated and fused state by mixing wax such as polypropylene and polyethylene in the toner and a method in which the surface of the heat roll is coated with a resin having a superior separation property such as fluorine-based resin have been proposed. However, waxes such as propylene and polyethylene have poor compatibility to polyester resins having a comparatively strong polarity, which are used in toner manufacturing processes, and the resulting problem is that it is difficult to disperse the wax uniformly. In order to solve such a problem, a technique has been proposed in which a modified wax such as an oxidized-type polyolefin wax having a polar group in the molecular terminal is used to improve the compatibility of the wax to a polyester resin and consequently to improve the dispersibility of the wax. However, although such a technique improves the dispersibility of the wax, the mold-releasing property, which is an inherent function of the wax, is lowered since the modified wax has a higher melt viscosity in comparison with an unmodified matter, with the result that the off-set phenomenon again tends to occur.

The problems with the anti-offset property and separation property are in particular conspicuous in full-color toner. In other words, in comparison with black toner, the full-color toner needs to have a higher heat-melting property upon application of heat for fixing with a lower viscosity, as well as improved gloss, transparency and color reproducibility. However, since a full-color toner using a resin that achieves these required properties tends to have low cohesion between molecules in the heat-melt state, the toner adhesion to the heating roller tends to occur upon passing through the fixing roller, resulting in insufficient separation and high-temperature offset. In order to prevent these insufficient separation and high-temperature offset, an attempt is made to reduce the toner adhesion to the fixing roller by coating the fixing roller with oil. However, the installation of the oil-coating mechanism causes problems of increase costs and a bulky device.

Therefore, an attempt has been made to disperse a wax in a toner by using an additive. For example, the following toners have been proposed: a toner containing a wax dispersion assistant having polyolefin (for example, Japanese Patent Application Laid-Open No. 2001-255690), a toner containing a wax dispersion assistant having a copolymer synthesized by using a styrene-based monomer and polyolefin (for example, Japanese Patent Application Laid-Open No. 2001-249485), a toner using alkylene glycidyl methacrylate as a wax dispersant (for example, U.S. Pat. No. 5,368,970), and toners containing as a wax dispersant a block polymer of ethylene and ethylene oxide (for example, Unisocks 550 (made by Toyo-Petrolite Co., Ltd.)) and/or a block polymer between polyethylene or polypropylene and propylene oxide, acrylic acid, caprolactone, caprolactam, alkyl oxazoline or vinyl chloride; polyethylene block polyester; polyethylene block polyvinylchloride; or polyethylene block polyvinylidene fluoride (for example, U.S. Pat. No. 5,344,737).

However, the total amount of addition of the wax in each of the above-mentioned toners is approximately 4%, and the particle size of the wax dispersant is relatively small; therefore, at the instant of fixing, the wax eluting speed is slow, failing to sufficiently satisfy the separating property from paper in an oilless fixing system in which no oil is applied to the fixing rollers. Since only the slight increase in the amount of wax makes the wax isolate comparatively easily, the cleaning property is lowered with the result that filming is generated on a photosensitive member, and lines, irregularities and black spots (BS) consequently generate on an image, causing problems with image quality. The heat-resistant storing property is lowered to easily cause aggregation in the toner. The degree of gloss in the resulting image is lowered.

SUMMARY OF THE INVENTION

The present invention is to provide a toner composition which exerts a sufficient separation property upon fixing and anti-offset property even in an oilless fixing system, and has superior image quality (with respect to lines, irregularities, black spots (BS), filming and gloss) as well as superior cleaning property and heat-resistant storing property.

The above object can be achieved by toner composition, comprising a binder resin, a wax, a copolymer and a colorant;

the copolymer being a copolymer of an $\alpha$-olefin, maleic anhydride and maleic acid monoester.

DETAILED DESCRIPTION OF THE INVENTION

Figure 1:
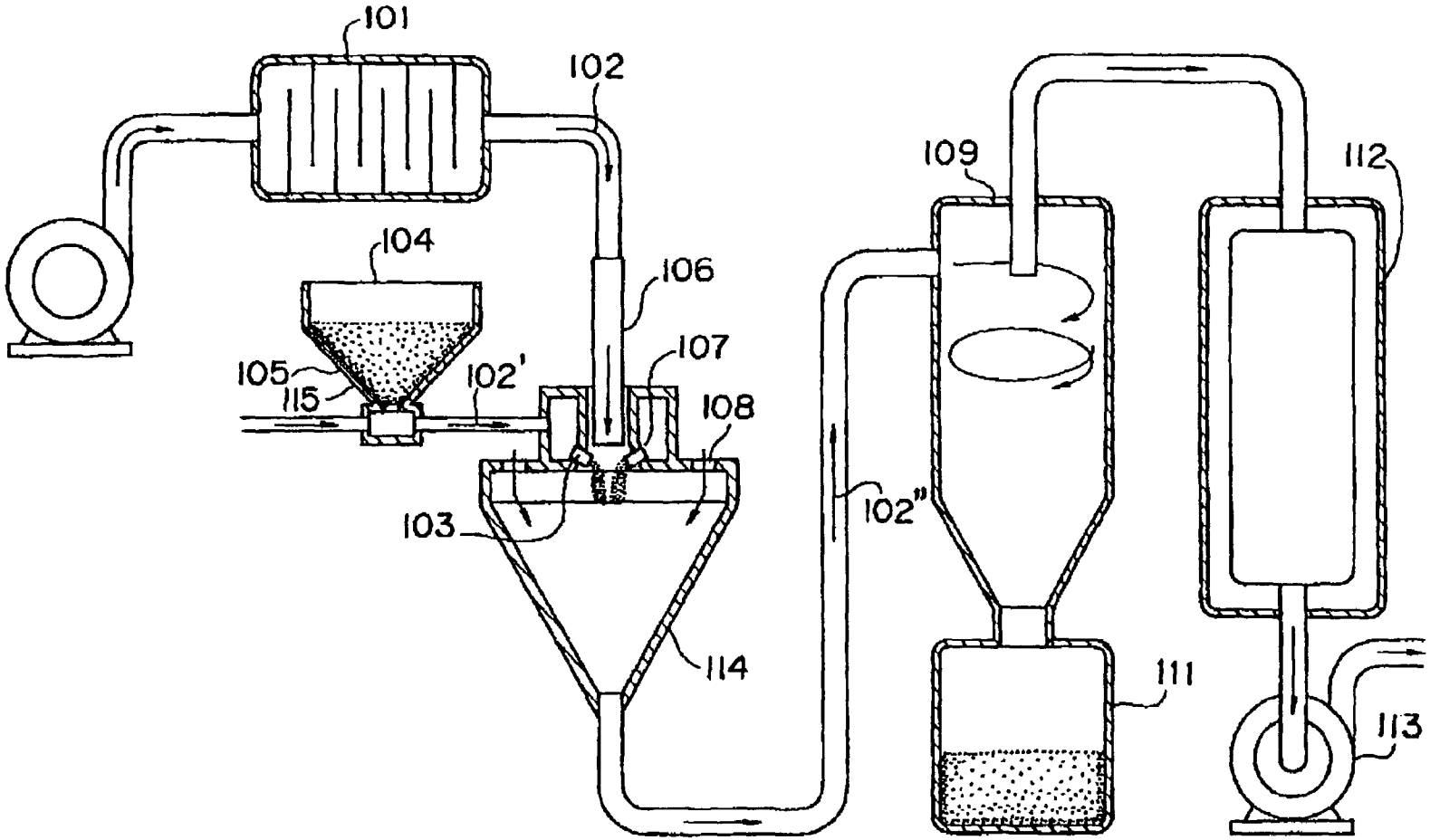
FIG. 1 is a schematic block diagram showing a device that is used for carrying out an instantaneous heating treatment.

The present invention relates to a toner composition, comprising a binder resin, a wax, a copolymer and a colorant;

the copolymer being a copolymer of an α-olefin, maleic anhydride and maleic acid monoester.

In the present specification, the concept of "toner composition" includes not only a toner that is obtained by melt-kneading toner materials such as a binder resin, wax and a colorant, and cooling, pulverizing and classifying the kneaded matter, but also the kneaded matter after the cooling process.

Characteristics, such as a separating property upon fixing, an anti-offset property, a cleaning property, image quality and a heat-resistant storing property, are generally referred to simply as "toner characteristics".

DESCRIPTION OF THE PREFERRED EMBODIMENTS

The toner of the present invention further contains a specific wax dispersant so that it is possible to disperse wax uniformly while effectively preventing separation of the wax from toner particles even in the case when a comparatively great amount of wax is contained therein. Consequently, it becomes possible to achieve a sufficient separation property upon fixing and an anti-offset property even in an oilless fixing system, and superior image quality (with respect to lines, irregularities, black spots (BS), filming and gloss) as well as superior cleaning property and heat-resistant storing property.

The wax dispersant to be used in the present invention is a copolymer of α-olefin-maleic anhydride copolymer-maleic acid monoester, that is, a copolymer between "an α-olefin-maleic anhydride copolymer" and a "maleic acid monoester", more preferably a graft copolymer formed by introducing a "maleic acid monoester" into "an α-olefin-maleic anhydride copolymer".

More specifically, the graft copolymer to be preferably used in the present invention is formed by graft-copolymerizing maleic anhydride monoester (maleic acid monoester) in "an α-olefin-maleic anhydride copolymer". The method of the graft copolymerization is not particularly limited as long as the above-mentioned graft copolymer is obtained, and, for example, a method in which a chain transfer reaction to "a copolymer between α-olefin and maleic anhydride" is utilized, a method in which a functional group capable of separating into free radicals is introduced into the above-mentioned copolymer to initiate a polymerizing process and a method in which an ion polymerizing process is started from the above-mentioned copolymer, are proposed.

With respect to α-olefin forming a wax dispersant, not particularly limited as long as the addition of the wax dispersant makes it possible to impart the separation-preventive effect of the wax and the effect for accelerating the uniformly dispersing property of the wax; and, for example, α-olefins having 2 to 10 carbon atoms, preferably 2 to 4 carbon atoms, can be used. Preferable specific examples thereof include ethylene, propylene and 1-butene, and in particular, ethylene and propylene are preferable. Two of more kinds of α-olefins may be used in combination.

The monoester of maleic anhydride is a monoalkyl ester of maleic acid. The alkyl is not particularly limited as long as it achieves the separation preventive effect of the wax and the uniform dispersion accelerating effect of the wax. For example, alkyl groups having 1 to 10 carbon atoms, preferably 1 to 4 carbon atoms, are used. Specific examples of preferable monoesters of maleic anhydride include: monomethyl esters of maleic acid, monomethyl esters of maleic acid, monopropyl esters of maleic acid and monobutyl esters of maleic acid, and in particular, monopropyl esters of maleic acid are preferably used. Two or more kinds of monoesters of maleic acid may be used in combination.

The content of maleic anhydride in the copolymer which is a wax dispersant in the present invention is set to 5 to 15% by weight, preferably 8 to 13% by weight, with respect to all the monomers constituting the copolymer. When the content of maleic anhydride is less than 5% by weight, the resulting wax dispersant fails to function as a compatibility-applying agent between a polyester-based resin and wax, in particular, polyolefin wax, making it difficult to maintain an uniformly dispersing property of the wax. When the content exceeds 15% by weight, the acid monomer generates a strong odor, causing a problem of toner odor upon fixing at a high temperature.

The acid value of such a wax dispersant is 80 to 170 KOHmg/g, preferably 120 to 165 KOHmg/g. With respect to the acid value of the wax dispersant, a measured value obtained based upon BWM3.01A is used.

The ester value of the wax dispersant is 30 to 60 KOHmg/g, preferably 30 to 55 KOHmg/g, most preferably 35 to 55 KOHmg/g. The ester value refers to the number of mg of potassium hydroxide that is required for completely saponifying ester contained in 1 g of the sample, and is indicated by a difference between the saponification value and the acid value in this invention. With respect to the saponification value of the wax dispersant, a measured value obtained based upon BWM3.02A is used.

The melting point of the wax dispersant is normally set to 60 to 90° C., preferably 70 to 80° C. With respect to the melting point of the wax dispersant, a value obtained based upon ASTMD36 is used.

The number-average molecular weight (Mn) is normally set to 600 to 8,000, preferably 2,000 to 4,000, and the value of the weight-average molecular weight (Mw)/number-average molecular weight (Mn) is normally set to 1.0 to 1.5, preferably 1.1 to 1.3. With respect to Mn and Mn, values obtained by gel permeation chromatography are used.

With respect to a commercially available product of the above-mentioned wax dispersant, for example, products of Ceramer series, made by Toyo-Petrolite Co., Ltd., are obtained. Specific examples include Ceramer 1608 and Ceramer 1251, and in particular, Ceramer 1608 is most preferably used in order to effectively improve the toner characteristics. Ceramer 1608 is a graft copolymer formed by introducing "monoisopropyl ester of maleic acid" into "a copolymer of propylene and maleic anhydride".

The content of the wax dispersant in the toner composition is not particularly limited as long as the addition of the wax dispersant imparts the effect for accelerating the separation preventive effect of the wax and the uniformly dispersing property of the wax to the toner, and is normally set to 1 to 10 parts by weight, preferably 2 to 7 parts by weight, with respect to 100 parts by weight of a binder resin, which will be described later.

The content of such a wax dispersant is preferably set to 30 to 100% by weight, preferably 30 to 70% by weight, with respect to the total content of the wax. Thus, both of the separation preventive effect of the wax and the uniformly dispersing property of the wax can be obtained more effectively.

Upon preparation of a toner composition, the above-mentioned wax dispersant with a smaller particle size is more preferably used. The wax dispersant is preferably pulverized to, for example, an average particle size of 1,000 μm or less, preferably 200 μm or less, more preferably 100 μm or less, further more preferably 50 μm or less, particularly 10 μm or less, in order to further accelerate the separation-preventive effect of the wax and the uniformly dispersing property of the wax.

With respect to the wax in this invention, waxes that have been conventionally used in the field of electrostatic-latent image developing toners may be used, and examples thereof include polyolefin-based waxes such as polyethylene wax and polypropylene wax, acid-modified waxes such as oxidation-type polyethylene wax and oxidation-type polypropylene wax, natural waxes such as carnauba wax and rice wax, and montan wax, Fischer-Tropsch wax, paraffin-based wax and polymer alcohol wax.

The acid-modified wax is obtained by allowing polyolefin such as polyethylene and polypropylene to addition-react with an acid monomer having a carboxylic group and a polymerizable double bond. With respect to the acid monomer, one kind or more of monomers selected from the group consisting of acrylic acid, methacrylic acid, maleic acid and maleic anhydride may be used. The acid value of the acid-modified wax is set to 1 to 60 KOHmg/g, more preferably 3 to 30 KOHmg/g.

In this invention, two different kinds of waxes are preferably used. Here, the expression, "different kinds of", refers to the fact that at least one of material (name of substance) and melting point is different.

Any of the two kinds of waxes are preferably polyolefin-based waxes, and, in particular, polyethylene wax and polypropylene wax are more preferably used in combination. Thus, the toner characteristics are improved more effectively.

The two kinds of waxes preferably have different melting points, and in particular, a low melting point wax having a melting point of 70 to 100° C. and a high melting point wax having a melting point of 120 to 150° C. are preferably used in combination. In the case when two kinds of waxes having different melting points are used, more preferably a polyethylene wax is used as the wax having a comparatively low melting point and a polypropylene wax is used as the wax having a comparatively high melting point.

The melting point of the wax is defined as a peak temperature in the DSC curve. With respect to the DSC curve, the present invention uses values obtained by measuring a sample of 10 mg using a differential scanning calorimeter (DSC-200: made by Seiko Instruments Inc.) with alumina being used as reference, under conditions of a temperature rising rate of 10° C./min and a temperature range of 20 to 200° C. Here, the above-mentioned device is not necessarily used as the measuring device, and any device may be used as long as it can measure the DSC curve.

Since this invention exerts the separation-preventive effect of the wax and the effect for accelerating the uniformly dispersing property of the wax, the invention is particularly effective when a comparatively great amount of wax is contained in the wax. In other words, the total content of the wax in the toner composition is set to 5 to 15 parts by weight, preferably 5.5 to 10 parts by weight with respect to 100 parts by weight of the binder resin. When waxes having different melting points are used as the two kinds of waxes, the content of the wax having a comparatively low melting point is preferably greater than the content of the wax having a comparatively high melting point. In particular, the content of the wax having a comparatively low melting point is preferably set to 4 to 10 parts by weight, while the content of the wax having a comparatively high melting point is preferably set to 0.1 to 2 parts by weight, with respect to 100 parts by weight of the binder resin.

In this invention, three or more "different kinds of" waxes may be used. In this case, the total content of all the waxes is preferably set in the above-mentioned range.

The two or more kinds of waxes to be used may be added when toner materials such as a binder resin and a colorant are mixed, and of the above-mentioned "two kinds of waxes", one of the waxes, preferably the wax having a comparatively low melting point, is preferably internally added upon synthesizing the binder resin. This arrangement makes the wax preliminarily dispersed in the resin, making it possible to charge the wax with a high filling rate, and to effectively improve the mold-releasing property of the toner.

The binder resin to be used in this invention is a polyester-based resin.

With respect to the polyester-based resin, a polyester-based resin, obtained by polycondensating a polyhydroxy alcohol component and a polycarboxylic acid component, can be used.

Among polyhydroxy alcohol components, examples of dihydroxy alcohol components include: bisphenol A alkylene oxide additives, such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane, polyoxyethylene(2,0)-2,2-bis(4-hydroxyphenyl)propane, ethyleneglycol, diethyleneglycol, triethyleneglycol, 1,2-propyleneglycol, 1,3-propyleneglycol, 1,4-butanediol, neopentylglycol, 1,4-butenediol, 1,5-pentanediol, 1,6-hexanediol, 1,4-cyclohexanedimethanol, dipropyleneglycol, polyethyleneglycol, polytetramethyleneglycol, bisphenol A and hydrogenized bisphenol A.

Examples of trihydroxy or more alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Among polycarboxylic acid components, examples of dicarboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenyl succinic acid, isooctenyl succinic acid, n-octyl succinic acid, isooctyl succinic acid, and anhydrides of these acids or low alkyl esters.

Examples of tri- or more carboxylic acid components include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butane tricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid, anhydrides of these acids, and low alkyl esters.

In this invention, with respect to the polyester-based resin, a mixture of a raw-material monomer for polyester resin, a raw-material monomer of vinyl-based resin and a monomer capable of reacting with the material monomers of both of the resins is used, and this is subjected to a polycondensation reaction for obtaining a polyester resin as well as a radical polymerization reaction for obtaining a vinyl-based resin in parallel with each other; thus, the resulting resin is also preferably used. In other words, the monomer capable of reacting with the material monomers of both of the resins is a monomer that can be used for both of the polycondensation reaction and the radical polymerization reaction. That is, this monomer has a carboxylic group that can undergo a polycondensation reaction and a vinyl group that can undergo a radical polymerization reaction, and examples thereof include fumaric acid, maleic acid, acrylic acid and methacrylic acid.

With respect to the raw-material monomer for polyester resin, the above-mentioned polyhydroxy alcohol components and polycarboxylic components are listed.

Examples of the raw-material monomer for the styrene-based resin include: styrene or styrene derivatives, such as styrene, o-methylstyrene, m-methylstyrene, p-methylstyrene, α-methylstyrene, p-ethylstyrene, 2,4-dimethylstyrene, p-tert-butylstyrene and p-chlorostyrene; ethylene unsaturated monoolefins, such as ethylene, propylene, butylene and isobutylene; methacrylic acid alkyl esters, such as methylmethacrylate, n-propylmethacrylate, isopropylmethacrylate, n-butylmethacrylate, isobutylmethacrylate, t-butylmethacrylate, n-pentylmethacrylate, isopentylmethacrylate, neopentylmethacrylate, 3-(methyl)butylmethacrylate, hexylmethacrylate, octylmethacrylate, nonylmethacrylate, decylmethacrylate, undecylmethacrylate and dodecylmethacrylate; acrylic acid alkyl esters, such as methylacrylate, n-propylacrylate, isopropylacrylate, n-butylacrylate, isobutylacrylate, t-butylacrylate, n-pentylacrylate, isopentylacrylate, neopentylacrylate, 3-(methyl)butylacrylate, hexylacrylate, octylacrylate, nonylacrylate, decylacrylate, undecylacrylate, and dodecylacrylate; unsaturated carboxylic acids, such as acrylic acid, methacrylic acid, itaconic acid and maleic acid; acrylonitrile, maleic acid ester, itaconic acid ester, vinyl chloride, vinylacetate, vinylbenzoate, vinylmethylethylketone, vinylhexylketone, vinylmethylether, vinylethylether, and vinylisobutylether. Examples of polymerization initiators used upon polymerizing the material monomers for the vinyl-based resin include azo or diazo polymerization initiators such as 2,2'-azobis(2,4-dimethylvaleronitrile), 2,2'-azobisisobutyronitrile, 1,1'-azobis(cyclohexane-1-carbonitrile) and 2,2'-azobis-4-methoxy-2,4-dimethylvaleronitrile and peroxide polymerization initiators such as benzoyl peroxide, methylethylketone peroxide, isopropylperoxycarbonate and lauroyl peroxide.

The acid value of the binder resin is set to 5 to 50 KOHmg/g, preferably 10 to 40 KOHmg/g. By using a resin having such an acid value, the dispersing property of carbon black and various colorants can be improved to form a toner having a sufficient quantity of charge.

The softening point of the binder resin is set to 100 to 130° C., preferably 110 to 120° C. The softening point of less than 100° C. causes degradation in the dispersing property of the wax, resulting in subsequent degradation in the separating property upon fixing. The softening point exceeding 130° C. tends to cause difficulty in obtaining a desired degree of gloss, resulting in a gloss-less image.

In the present invention, in order to further improve the separating property upon fixing and the anti-offset property that are exerted, in particular, as an oilless fixing toner, a first polyester-based resin having a softening point of 95 to 115° C. and a second polyester-based resin having a softening point of 110 to 130° C. are preferably used as the polyester-based resin. More preferably the softening point of the first polyester-based resin is set to 90 to 110° C., and the softening point of the second polyester-based resin is set to 115 to 150° C. In order to further improve the heat resistant property of the toner, the glass transition point of the first and second polyester-based resins is set to 50 to 75° C., preferably 55 to 70° C. In the case when two kinds of resins are used as the binder resin in this manner, the acid value and the softening point of the mixed resin are respectively set in the above-mentioned ranges.

With respect to the first polyester-based resin, a polyester resin, obtained by polymerization-condensing the above-mentioned polyhydroxy alcohol component and polycarboxylic acid component, in particular, a polyester resin, obtained by using a bisphenol A alkylene oxide adduct as a main component of the polyhydroxy alcohol component while using at least one material selected from the group consisting of terephthalic acid and fumaric acid as a main component of the polycarboxylic acid component, is preferably used.

With respect to the second polyester-based resin, a polyester resin, obtained by polymerization-condensing a monomer component containing at least the above-mentioned trihydroxy or more alcohol component and/or tri- or more carboxylic acid component, in particular, a polyester resin, obtained by using a bisphenol A alkylene oxide adduct as a main component for a dihydroxy alcohol component, while using trimellitic acid as a tri- or more carboxylic acid as well as using at least one material selected from the group consisting of terephthalic acid, fumaric acid and dodecenyl succinic acid as a main component for a dicarboxylic acid component, is preferably used.

With respect to the second polyester-based resin, a mixture of a material monomer of polyester resin, a material monomer of vinyl-based resin and an amphoteric reactive monomer that react with the material monomers of both of the resins is used so that a polycondensation reaction for obtaining a polyester resin and a radical polymerization reaction for obtaining a vinyl-based resin are carried out in parallel with each other; thus, the resulting polyester-based resin is preferably used. Such a resin is preferably applied in order to improve the dispersing property of the wax and the toughness, fixing property and anti-offset property of the toner. In this case, the content of the vinyl-based resin in the second polyester-based resin is preferably set to 5 to 30 weight %, more preferably 10 to 25 weight %.

The above-mentioned second polyester-based resin preferably contains a component that is insoluble to tetrahydrofran (THF) in order to improve the high-temperature anti-offset property. From this viewpoint, the first and second polyester-based resins are preferably used in a manner so as to set the content of the THF insoluble component in the binder resin to 0.1 to 30 weight %, preferably 0.4 to 10 weight %.

In order to further improve the separating property upon fixing and the anti-offset property, the amount of use of the second polyester-based resin at its weight ratio is preferably greater than that of the first polyester-based resin. More preferably the weight ratio of the first polyester-based resin and the second polyester-based resin is set to 40:60 to 20:80.

In order to internally add one of two kinds of waxes preliminarily to a binder resin, upon synthesizing the binder resin, the binder resin is synthesized with one of the two kinds of waxes being added to monomers to be used for synthesizing the binder resin. In particular, in the case when the above-mentioned first polyester-based resin (low molecular-weight resin) and second polyester-based resin (high molecular-weight resin) are used in combination as the binder resin, since the second polyester-based resin has difficulty in dissolving wax in comparison with the first polyester-based resin, one of two kinds of waxes (preferably a wax having comparatively low melting point) is preferably added preliminarily upon, synthesizing the second polyester-based resin. More specifically, the polycondensation reaction (and a radical polymerization reaction, if necessary) is carried out in a state in which the wax has been added to an acid monomer and an alcohol monomer (as well as a material monomer for a vinyl-based resin to be used, if necessary) that form the second polyester-based resin. With respect to the amount of addition of the internally-added wax in this case, any amount is used as long as the content of wax in the resulting toner composition is set in the above-mentioned range, and, more preferably the ratio of the amount of use of the internally added wax to the sum of the amount of use of all the monomers of the second polyester-based resin to be synthesized in order to further improve the toner characteristics and the amount of use of the internally-added is set in a range of 7 to 15 weight %, preferably 7 to 10 weight %.

In the case when the wax is internally added to the binder resin preliminarily, the acid value and softening point of the binder resin with the wax internally added thereto are respectively set in the above-mentioned ranges.

With respect to colorants contained in the toner of the present invention, conventionally known pigments and dyes to be used as colorants for electrostatic latent image developing toners may be used. Examples thereof include carbon black, aniline blue, Chalco Oil Blue, chrome yellow, ultramarine blue, DuPont Oil Red, quinoline yellow, methylene blue chloride, copper phthalocyanine, Malachite green oxalate, Lump Black, Rose Bengal, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Solvent Yellow 162, C.I. Pigment Yellow 180, C.I. Pigment Yellow 185, C.I. Pigment Blue 15:1, C.I. Pigment Blue 15:3, etc. The content of the colorants is preferably set in a range of 2 to 15 parts by weight with respect to 100 parts by weight of the binder resin.

From the viewpoint of a dispersing property of the colorant in the toner, the colorant is preferably used in the form of a master batch that is obtained by melt-kneading it with a binder resin to be used and cooling and pulverizing the resulting matter. When the colorant is used in the form of a master batch, the amount of use of the master batch is preferably set to such an amount that the content of the colorant in the toner composition is in the above-mentioned range.

The toner of the present invention may contain additives such as a charge-control agent and magnetic powder.

With respect to the charge-control agent, well-known charge control agents that are conventionally added so as to control the charging property in the field of electrostatic latent image developing toners may be used. Examples thereof include: a fluorine-based surfactant, a metal complex of derivatives of salicylic acid, a metal-containing dye such as an azo-based metal compound, a high-molecular acid such as a copolymer containing maleic acid as a monomer component, a calix arene compound and an organic boron compound.

The toner of the present invention is obtained through the following processes: After a binder resin, a wax, a wax dispersant, a colorant and other desired additives have been melt-kneaded, and cooled, the resulting matter is pulverized and classified. In this case, the wax may be mixed simultaneously with the toner materials such as the binder resin and the colorant, or may be preliminarily added upon synthesizing the binder resin as described earlier.

The volume-average particle size of the toner is preferably set to 4 to 10 μm, more preferably 5 to 8 μm.

In the present invention, the resulting toner particles are preferably subjected to an instantaneous heating treatment (surface modifying process) after having been further subjected to a mixing process with inorganic fine particles. In the toner of the present invention, since separation (isolation) of wax particles is effectively prevented, the instantaneous heating treatment hardly causes the generation of joined particles, thereby making it possible to effectively form spherical toner particles, and consequently to provide an image with high precision.

By mixing the inorganic fine particles with the toner particles prior to the instantaneous heating treatment (hereinafter, referred to as pre-processing of inorganic fine particles), the fluidity of the toner particles is improved, and the uniformly-dispersing property is also improved upon carrying out the instantaneous heating treatment. It is possible to prevent the toner particles from mutually aggregating upon carrying out the heating treatment.

Examples of the above-mentioned inorganic fine particles include: various carbides, such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamond carbon lactam, various nitrides such as boron nitride, titanium nitride and zirconium nitride, bromide such as zirconium bromide, various oxides, such as titanium oxide, calcium oxide, magnesium oxide, zinc oxide, copper oxide, aluminum oxide, silica and colloidal silica, various titanic acid compounds, such as calcium titanate, magnesium titanate and strontium titanate, sulfides such as molybdenum disulfide, fluorides such as magnesium fluoride and carbon fluoride, various metal soaps, such as aluminum stearate, calcium stearate, zinc stearate and magnesium stearate, and various nonmagnetic inorganic fine particles such as talc and bentonite. These materials may be used alone or in combination. With respect to these inorganic fine particles, those having a BET specific surface area of 10 to 350 $m^2/g$ are preferably used.

The instantaneous heating treatment is carried out by dispersing and spraying toner particles into a hot air flow by using compressed air.

Figure 2:
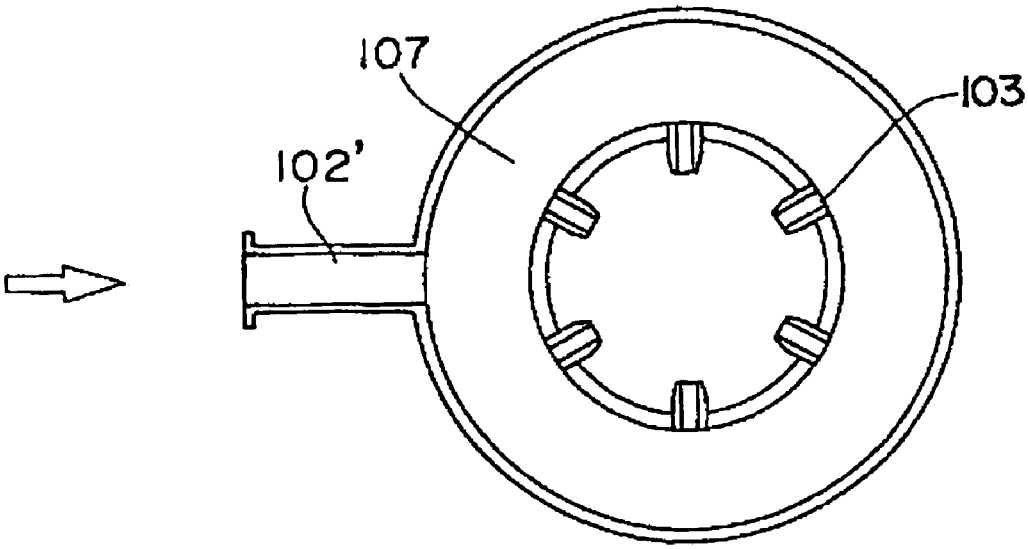
FIG. 2 is a schematic horizontal cross-sectional view showing a sample discharging chamber in the device shown in FIG. 1.

Referring to schematic views of FIGS. 1 and 2, the following description will discuss the construction of a device that carries out the instantaneous heating treatment.

As illustrated in FIG. 1, high-temperature, high-pressure air (hot air), formed in a hot-air generating device 101, is discharged by a hot-air discharging nozzle 106 through a directing tube 102. Toner particles 105 are carried by a predetermined amount of pressurized air from a fixed amount supplying device 104 through a directing tube 102', and fed to a sample-discharging chamber 107 installed around the hot-air discharging nozzle 106.

As illustrated in FIG. 2, the sample-discharging chamber 107 has a hollow doughnut shape, and a plurality of sample-discharging nozzles 103 are placed on its inside wall with the same intervals. The toner particles, sent to the sample-discharging chamber 107, are allowed to spread inside the discharging chamber 107 in an uniformly dispersed state, and discharged through the sample-discharging nozzles 103 into the hot air flow by the pressure of air successively sent thereto.

Here, it is preferable to provide a predetermined tilt to the sample-discharging nozzles 103 so as not to allow the discharging flow from each sample-discharging nozzle 103 to cross the hot air flow. More specifically, the toner discharging flow is preferably directed in a manner so as to go along the hot air flow to a certain extent; and the angle formed by the toner discharging flow and the direction of the central flow of the hot air flow is preferably set in the range of 20 to 40° C., preferably 25 to 35° C.

A plurality of the sample-discharging nozzles 103 are required, and the number thereof is preferably set to at least not less than 3, and more preferably not less than 4. The application of a plurality of sample-discharging nozzles makes it possible to uniformly disperse the toner particles into the hot air flow, and to ensure a heating treatment for each of the toner particles. With respect to the discharged state from the sample-discharging nozzle, it is preferably arranged so that the toner particles are widely scattered at the time of discharging and dispersed to the entire hot air flow without collision with other toner particles.

The toner particles, thus discharged, are allowed to contact the high-temperature hot air instantaneously, and subjected to a heating treatment uniformly. Here, "instantaneously" refers to a time period during which a required toner-particle modification (heating treatment) has been achieved without causing aggregation between the toner particles; and although it depends on the processing temperature and the density of toner particles in the hot air flow, this is normally set at not more than 2 seconds, and more preferably not more than 1 second. This instantaneous time period is represented as a residence time of toner particles from the time when the toner particles are discharged from the sample-discharging nozzles to the time when they are guided into the directing tube 102". The residence time exceeding 2 seconds tends to cause joined particles.

Next, the toner particles, which have been instantaneously heated, are cooled off by a cold air flow directed from a cooling-air directing section 108, and collected into a cyclone 109 through the directing tube 102" without adhering to the device walls and causing aggregation between particles, and then stored in a production tank 111. The carrier air from which the toner particles have been removed is allowed to pass through a bug filter 112 by which fine powder is removed therefrom, and released into the air through a blower 113. Here, the cyclone 109 is preferably provided with a cooling jacket through which cooling water runs, so as to prevent aggregation of toner particles.

In addition, important conditions for carrying out the instantaneous heating treatment include an amount of hot air, an amount of dispersing air, a dispersion density, a processing temperature, a cooling air temperature, an amount of suction air and a cooling water temperature.

The amount of hot air refers to an amount of hot air supplied by the hot-air generating device 101. The greater the amount of hot air, the better in an attempt to improve the homogeneity of the heating treatment and the processing performance.

The amount of dispersing air refers to an amount of air that is to be sent to the directing tube 102' by the pressurized air. Although it also depends on other conditions, the amount of dispersing air is preferably suppressed during the heating treatment; this provides a better dispersed state of toner particles in a stable manner.

The dispersion density refers to a dispersion density of toner particles in a heating treatment area (more specifically, a nozzle discharging area). A preferable dispersion density varies depending on the specific gravity of toner particles; and the value obtained by dividing the classified density by the respective toner particles is preferably set in the range of 50 to 300 g/m$^3$, preferably 50 to 200 g/m$^3$.

The processing temperature refers to a temperature within the heating treatment area. In the heating treatment area, a temperature gradient spreading outwards from the center actually exists, and it is preferable to reduce this temperature distribution at the time of the heating treatment. It is preferable to supply an air flow in a stable layer-flow state from the device face by using a stabilizer, etc.

The cooling air temperature refers to a temperature of cold air directed from the cooling-air directing section 108. The toner particles, after having been subjected to an instantaneous heating treatment, are preferably returned to an atmosphere under the glass transition point by using cold air so as to be cooled to a temperature range which causes no aggregation or joining of the toner particles.

The amount of suction air refers to air used for carrying the processed toner particles to the cyclone by the blower 113. The greater the amount of suction air, the better in reducing the aggregation of the toner particles.

The temperature of cooling water refers to the temperature of cooling water inside the cooling jacket installed in the cyclones 109 and 114 and in the directing tube 102".

External additive agents are added to the toner particles that have been subjected to the instantaneous heating treatment. With respect to the external additive agents, at least first inorganic fine particles having a BET specific surface area of 100 to 300 m$^2$/g, more specifically, 150 to 250 m$^2$/g, and second inorganic fine particles having a BET specific surface area of 5 to 30 m$^2$/g, more preferably 5 to 20 m$^2$/g, are used. By externally adding the first inorganic fine particles, the toner fluidity is improved, and the uniformly-charging property is also improved; therefore, it is possible to ensure stable durability for a long time. When the second inorganic fine particles are externally added, the particles are allowed to serve as spacers between the toner particles, making it possible to prevent mutual aggregation between the toner particles, and consequently to improve the heat-resistant storing property.

With respect to the first and second inorganic fine particles, the same materials as those of the above-mentioned inorganic fine particles may be used; and, silica is preferably used as the first inorganic fine particles. A titanate compound, in particular, strontium titanate, is preferably used as the second inorganic fine particles.

The amount of addition of the first inorganic fine particles is preferably set to 0.3 to 3.0 weight % with respect to the toner particles. The amount of addition of the second inorganic fine particles is preferably set to 0.3 to 3.0 weight % with respect to the toner particles.

Upon fixing a toner image formed by the toner of the present invention, a recording sheet (for example, a sheet of paper) bearing the toner image is allowed to pass through a press-contact section between a heating member and a pressing member or a press-heating member placed in press-contact with the heating member. In this case, an oilless fixing method that requires no fixing oil is preferably adopted. In particular, from the viewpoint of effectively separating the sheet of paper from the heating member, a nip structure having a convex shape upward in the press-contact section is preferably used. From the viewpoint of further improving the separating property between the sheet of paper and the heating member, the surface thereof is preferably made from a fluorine-based resin, such as PFA (ethylene tetrafluoride-perfluoroalkyl vinyl ether copolymer), polyethylene tetrafluoride and polyvinylidene fluoride.

Figure 3:
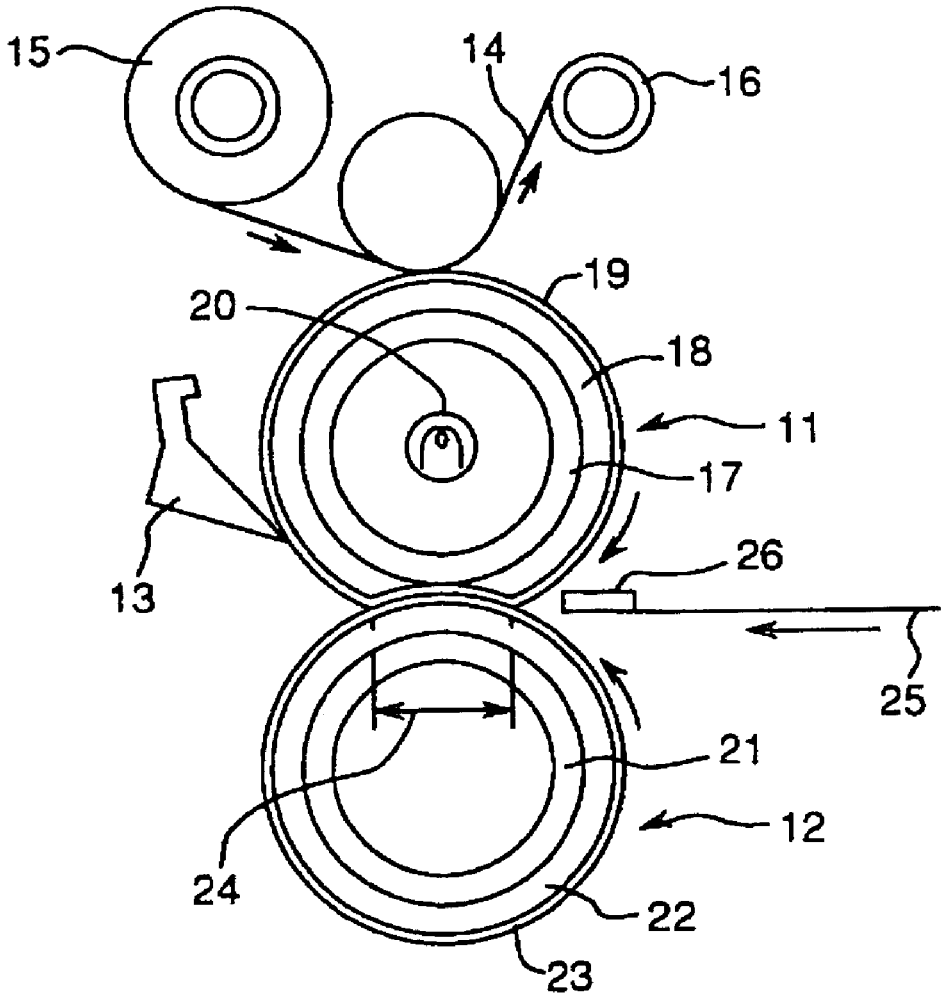
FIG. 3 is a schematic block diagram showing a fixing device that is suitably used for the toner of the present invention.

With respect to the oilless fixing device using such a fixing method, a fixing device, schematically shown in FIG. 3, may be preferably used. The fixing device of FIG. 3 uses a heating roller 11 serving as the heating member and a pressing roller 12 serving as the pressing member. More specifically, it is provided with the heating roller 11, the pressing roller 12 that is made in press-contact with the heating roller, a separation claw 13 used for separating a sheet that has been subjected to a fixing process from the heating roller, a cleaning web 14 used for cleaning the surface of the heating roller, a web roller 15 on which the cleaning web is wound and a take-up roller 16 for winding the cleaning web up. The heating roller 11 is normally constituted by an elastic layer 18 and a surface layer 19 formed on an aluminum core metal member 17, with a heater 20 being installed in the aluminum core metal member. The pressing roller 12 is normally constituted by an elastic layer 22 and a surface layer 23 formed on an aluminum core metal member 21. Although not particularly limited, the material of the elastic layers (18, 22) is preferably silicone rubber. Although not particularly limited, the material of the surface layers (19, 23) is preferably a fluorine-based resin, in particular, PFA.

In FIG. 3, a nip 24 having a convex shape on the heating roller side (upward) is formed on the press contact section between the heating roller 11 and the pressing roller 12. A recording sheet 25 bearing a toner image 26 is allowed to pass through the press contact section from right to left in the figure so that a fixing process is carried out.

EXAMPLES (Production Example of Polyester Resin to Which Wax is Internally Added (Resins 1 to 6))

Styrene and butyl acrylate serving as monomers for a vinyl-based resin and dicumyl peroxide serving as a polymerization initiator were loaded into a dropping funnel. Next, to a four-neck flask provided with a thermometer, a stainless stirring stick, a dropping-type condenser and a nitrogen gas directing tube were loaded an alcohol component and an acid component, which were adjusted to a ratio as shown in Table 1, together with fumaric acid serving as an amphoteric reactive compound, in addition to dibutyl peroxide serving as an esterification catalyst and wax shown in Table 1, with amounts of addition shown in Table 1, and while this was heated and stirred in a mantle heater in a nitrogen gas atmosphere, the monomers for a vinyl-based resin and the polymerization initiator preliminarily prepared were added to this through the dropping funnel in a long time. After the addition polymerization reaction had been matured while maintained at a predetermined temperature, this was again heated to undergo a condensation polymerizing reaction. Here, the progress of the reaction was followed by measuring its acid value or softening point. At the time of reaching a predetermined acid value or softening point, the reaction was completed, and this was cooled to room temperature; thus, a composite polyester resin was obtained.

(Production Example of Polyester Resin (Resin 7) to Which no Wax is Internally Added)

To a four-neck flask provided with a thermometer, a stainless stirring stick, a dropping-type condenser and a nitrogen gas directing tube were loaded an alcohol component and an acid component together with a polymerization initiator (dibutyl tin oxide) at a ratio shown in Table 1. This mixture was heated while being stirred in a mantle heater under a nitrogen gas flow, and allowed to react with each other. Here, the progress of the reaction was followed by measuring its acid value. At the time of reaching a predetermined acid value, the reaction was completed, and this was cooled to room temperature; thus, a polyester resin was obtained.

Each of the resulting polyester resins was coarsely pulverized to a particle size of not more than 1 mm, and used in the following toner manufacturing processes. The physical properties of the respective polyester resins are shown in Table 2.

TABLE 1

| | Monomer in polyester resin | | | | | | Monomer in vinyl based resin | | | Internally added |
|---|---|---|---|---|---|---|---|---|---|---|
| | BPA-PO | BPA-EO | TPA | TMA | DSA | Fumaric acid | St | BA | Polymerization initiator | wax Kind (amount of addition) |
| Resin 1 | 375 g | 375 g | 200 g | 50 g | 50 g | 50 g | 200 g | 40 g | 10 g | PW500 (7% by weight) |
| Resin 2 | 375 g | 375 g | 200 g | 50 g | 50 g | 50 g | 200 g | 40 g | 10 g | PW500 (8% by weight) |
| Resin 3 | 375 g | 375 g | 200 g | 50 g | 50 g | 50 g | 200 g | 40 g | 10 g | PW500 (9% by weight) |
| Resin 4 | 375 g | 375 g | 200 g | 50 g | 50 g | 50 g | 200 g | 40 g | 10 g | PW400 (8% by weight) |
| Resin 5 | 375 g | 375 g | 200 g | 50 g | 50 g | 50 g | 200 g | 40 g | 10 g | PW500 (8% by weight) |
| Resin 6 | 400 g | 350 g | 200 g | 50 g | 50 g | 50 g | 200 g | 40 g | 10 g | PW500 (8% by weight) |
| Resin 7 | 620 g | 230 g | 150 g | 0 | 0 | 100 g | — | — | — | — |

In this Table, the amount of addition of wax is represented by a ratio of the amount of use of wax with respect to the sum of the amount of use of all the monomers including the polyester resin and the vinyl-based resin and the amount of use of wax.

The abbreviations are explained as follows:

BPA-PO: Bisphenol A propylene oxide adduct,

BPA-EO: Bisphenol A ethylene oxide adduct,

TPA: Terephthalic acid,

TMA: Trimellitic acid,

DSA: Succinic acid derivative,

St: Styrene,

BA: Butyl acrylate.

TABLE 2

| | Tg (° C.) | Tm (° C.) | Acid Value (KOH mg/g) | Hydroxyl Value (KOH mg/g) | THF Insoluble matter (%) |
|---|---|---|---|---|---|
| Resin 1 | 62.3 | 116.8 | 27.6 | 17.1 | 0.8 |
| Resin 2 | 63.8 | 119.2 | 26.9 | 25.6 | 1.0 |
| Resin 3 | 61.4 | 118.9 | 29.1 | 24.3 | 1.0 |
| Resin 4 | 60.4 | 117.9 | 25.3 | 14.7 | 0.9 |
| Resin 5 | 63.7 | 120.4 | 31.1 | 20.6 | 0.9 |
| Resin 6 | 61.6 | 115.1 | 29.6 | 25.1 | 0.7 |
| Resin 7 | 60.8 | 105.2 | 5.9 | 20.4 | — |

Waxes used in the Examples are shown below:

TABLE 3

| Name | Component | Melting point |
|---|---|---|
| PW400 | PE Wax (Toyo-Petrolite Co., Ltd) | 80° C. |
| PW500 | PE Wax (Toyo-Petrolite Co., Ltd) | 85° C. |
| PW655 | PE Wax (Toyo-Petrolite Co., Ltd) | 100° C. |
| 550P | PP Wax (Sanyo Chemical Industries Ltd.) | 145° C. |
| 100TS | PP Wax (Sanyo Chemical Industries Ltd.) | 135° C. |

With respect to the wax dispersant, Ceramers 1608, 1251 and 67 (made by Toyo-Petrolite Co., Ltd.) were used. Each of these commercially available products is made of bead-shaped particles having an average particle size of about 6 mm. These products are also prepared as pulverized particles having average particle sizes of 150 μm, 50 μm and 10 μm.

TABLE 4

| | Maleic anhydride content (% by weight) | Acid Value (KOH mg/g) | Ester Value (KOH mg/g) | Melting point (° C.) | Mn | Mw/Mn |
|---|---|---|---|---|---|---|
| CERAMER 1608 | 13 | 154 | 36 | 77 | 2580 | 1.2 |
| CERAMER 1251 | 8 | 125 | 31 | 78 | 1680 | 1.2 |
| CERAMER 67 | 4 | 48 | 29 | 97 | 655 | 1.1 |

Production Example of Pigment Master Batch

With respect to pigments to be used in the following production of a full-color toner, a pigment master batch was prepared in the following manner, and used as the material thereof. The binder resin to be used in each of examples and C.I. Pigment Red 57-1 were loaded into a pressure kneader at a weight ratio of 7:3, and kneaded for 1 hour at 120° C. After having been cooled, the kneaded matter was coarsely pulverized with a hammer mill to obtain a pigment master batch having a pigment content of 30 weight %.

Production Example of Toner

Example 1

Resin 2 and resin 7, shown in Table 5, were used as the binder resin at a weight ratio of 70:30. To 100 parts by weight of such a binder with wax internally added thereto (including the weight of the internally added wax) were added a master batch virtually containing 4.0 parts by weight of C.I. Pigment Red 57-1 (made by Fuji Shikiso K.K.), 1 part by weight of oxidation-type low-molecular polypropylene wax (100-TS; made by Sanyo Chemical Industries Ltd.) and 4 parts by weight of Ceramer 1608 (having a bead shape, made by Toyo-Petrolite Co., Ltd.), and after having been sufficiently mixed by a Henschel mixer, the resulting mixture was melt-kneaded by using a twin-screw extruder kneader (PCM-63 made by Ikegai Corporation). The resulting kneaded matter was rolled by a cooling press, and cooled off by using a cooling belt, and then coarsely pulverized with a feather mill. Thereafter, the resulting matter was pulverized by using a mechanical pulverizing device (KTM: made by Kawasaki Heavy Industries Ltd.) to an average particle size of 10 to 12 μm, and further pulverized and coarsely classified by a jet mill (IDS: made by Nippon Pneumatic Mfg. Co., Ltd.) to an average particle size of 6.8 μm, and then finely classified by a rotor-type classifier (Teeplex-type classifier 100ATP: made by Hosokawamicron Corp.) to obtain magenta toner particles having a volume-average particle size of 7.5 μm.

To 100 parts by weight of these toner particles were added 1.0 part by weight of hydrophobic silica (TS-500: made by Showa Cabot K.K.) and 1.0 part by weight of hydrophobic silica (AEROSIL 90G: made by Nippon Aerosil Co., Ltd.) subjected to a modifying treatment by hexamethylenedisilazane: BET specific surface area 65 $m^2/g$, pH of 6.0; degree of hydrophobic property of not less than 65%), and this was mixed by a Henschel mixer (peripheral speed 40 m/sec, for 60 seconds), and then subjected to a surface-modifying treatment by heat under the following conditions by using a device shown in FIG. 1; thus, magenta toner particles were obtained. To 100 parts by weight of these toner particles were further added 0.5 parts by weight of hydrophobic silica fine particles (TS-500; made by Showa Cabot K.K.) having a BET specific surface area of 225 $m^2/g$ and 0.5 parts by weight of strontium titanate fine particles having a BET specific surface area of 9 $m^2/g$, and this was mixed by a Henschel mixer at a peripheral speed of 40 m/sec for 3 minutes, and then filtered through a sieve of 106 μm mesh to obtain a toner.

(Conditions of Surface Modifying Treatment)

Developer supplying section; Table feeder+vibration feeder

Dispersing nozzle; Four (Symmetric layout with 90 degrees respectively to all circumference)

Discharging angle; 30 degrees

Amount of hot air; 800 L/min

Amount of dispersing air; 55 L/min

Amount of suction air; −1200 L/min

Dispersion density; 100 $gm^3$

Processing temperature; 180° C.

Residence time; 0.5 second

Temperature of cooling air; 15° C.

Temperature of cooling water; 10° C.

(Examples 2 to 12 and Comparative examples of 1 to 3 )

Toners were obtained by carrying out the same processes as Example 1 except that the kind and mixing ratio of the resin forming the binder, the kind and the amount of addition of the externally added wax and the kind, amount of addition and shape of the wax dispersant were changed as shown in Table 5.

TABLE 5

| | Binder resin | | | | | Wax dispersant | | | |
|---|---|---|---|---|---|---|---|---|---|
| | High polymer (parts by weight) | Low polymer (parts by weight) | Internally added wax Kind (amount (parts by weight)) | Mixed resin Tm | Externally added wax Kind (amount (parts by weight)) | Name | Amount of addition (parts by weight) | Ratio to total wax | Shape of dispersant |
| Ex. 1 | resin 2 (70) | resin 7 (30) | PW500 (5.6/5.4) | 113.5° C. | 100TS (1/0.96) | CERAMER 1608 | 4/3.9 | 61% | beads-shaped |
| Ex. 2 | resin 3 (70) | resin 7 (30) | PW500 (6.3/6.1) | 113.5° C. | 100TS (1/0.97) | CERAMER 1608 | 5/4.9 | 68% | beads-shaped |
| Ex. 3 | resin 1 (70) | resin 7 (30) | PW500 (4.9/4.7) | 113.5° C. | 100TS (1/0.96) | CERAMER 1608 | 4/3.8 | 68% | beads-shaped |
| Ex. 4 | resin 5 (70) | resin 7 (30) | PW500 (5.6/5.4) | 116.0° C. | 100TS (1/0.96) | CERAMER 1608 | 4/3.9 | 61% | beads-shaped |
| Ex. 5 | resin 6 (70) | resin 7 (30) | PW500 (5.6/5.4) | 111.5° C. | 100TS (1/0.96) | CERAMER 1608 | 4/3.9 | 61% | beads-shaped |
| Ex. 6 | resin 2 (70) | resin 7 (30) | PW500 (5.6/5.4) | 113.5° C. | 100TS (1/0.96) | CERAMER 1251 | 4/3.9 | 61% | beads-shaped |
| Ex. 7 | resin 2 (70) | resin 7 (30) | PW500 (5.6/5.4) | 113.5° C. | 100TS (1/0.96) | CERAMER 1608 | 2.5/2.4 | 38% | beads-shaped |
| Ex. 8 | resin 2 (70) | resin 7 (30) | PW500 (5.6/5.4) | 113.5° C. | 100TS (1/0.96) | CERAMER 1608 | 6/5.8 | 91% | beads-shaped |
| Ex. 9 | resin 2 (70) | resin 7 (30) | PW500 (5.6/5.4) | 113.5° C. | 100TS (1/0.96) | CERAMER 1608 | 4/3.9 | 61% | 150 μm |
| Ex. 10 | resin 2 (70) | resin 7 (30) | PW500 (5.6/5.4) | 113.5° C. | 100TS (1/0.96) | CERAMER 1608 | 4/3.9 | 61% | 50 μm |
| Ex. 11 | resin 2 (70) | resin 7 (30) | PW500 (5.6/5.4) | 113.5° C. | 100TS (1/0.96) | CERAMER 1608 | 4/3.9 | 61% | 10 μm |
| Ex. 12 | resin 4 (70) | resin 7 (30) | PW400 (5.6/5.4) | 113.5° C. | 100TS (1/0.96) | CERAMER 1608 | 4/3.9 | 61% | beads-shaped |
| Com. Ex. 1 | resin 2 (70) | resin 7 (30) | PW500 (5.6/5.4) | 113.5° C. | 100TS (1/0.96) | — | — | — | — |
| Com. Ex. 2 | resin 2 (70) | resin 7 (30) | PW500 (5.6/5.4) | 113.5° C. | 100TS (1/0.96) | CERAMER 67 | 4/3.9 | 61% | beads-shaped |
| Com. Ex. 3 | resin 2 (70) | resin 7 (30) | PW500 (5.6/5.4) | 113.5° C. | none | CERAMER 67 | 4/3.9 | 71% | beads-shaped |

In the Table, with respect to the amount of the internally-added wax, the upper stage represents the amount of the internally-added wax contained in 100 parts by weight of the binder resin (containing the weight of the internally-added wax) to which the wax is internally added. The lower stage represents the amount of the internally-added wax with respect to 100 parts by weight of only the binder resin (not containing the weight of the internally-added wax) containing a binder resin contained in the pigment master batch.

Here, Tm of the mixed resin refers to Tm of the binder resin containing the internally-added wax.

With respect to the amount of the externally-added wax, the upper stage represents a value with respect to 100 parts by weight of the binder resin (containing the weight of the internally-added wax) to which the wax is internally added. The lower stage represents a value with respect to 100 parts by weight of only the binder resin (not containing the weight of the internally-added wax) containing a binder resin contained in the pigment master batch.

With respect to the amount of addition of the wax dispersant, the upper stage represents a value with respect to 100 parts by weight of the binder resin (containing the weight of the internally-added wax) to which the wax is internally added. The lower stage represents a value with respect to 100 parts by weight of single binder resin (not containing the weight of the internally-added wax) containing a binder resin contained in the pigment master batch.

Evaluation (Heat Resistance)

Toner (20 g) was put into a glass bin, and this was maintained at a high temperature of 55° C. for 24 hours, and the toner was visually observed.

○: No aggregated particles were observed, causing no problems.

Δ: Soft aggregation was partially observed, but easily crumbled, causing no problems in practical use.

×: There were aggregation of solidified particles and clumps that were hardly crumbled, causing problems in practical use.

(Separation Test Upon Fixing)

A full-color printer LP-3000C (made by Seiko Epson Corp.) of a non-magnetic one-component developing system was used to form an unfixed image made of printed solid strip images (amount of adhesion 5 g/m$^2$) on 5 mm of leading edge with a width of 36 mm of an A-4 longitudinal test pattern sheet. This unfixed image was fixed at various fixing temperatures by using the following fixing devices to find a separable/non-offset temperature range. This temperature range refers to a temperature range in which paper separation is easily carried out from the heating roller without causing any offset phenomenon. With respect to the paper used and the paper-transporting direction, a longitudinal transport sheet of Y order of 64 g/m$^2$ paper, which was not advantageous in separating property, was used. The peripheral speed of the fixing device was set to 120 mm/sec.

The fixing device is a device of a soft roller type shown in FIG. 3, which has a fluorine-based surface agent structure. More specifically, the heating roller 11, which has an outer diameter of 40 mm, is provided with an elastic layer 18 that is 1.5 mm in thickness, and made of silicone rubber formed on an aluminum core metal member 17 and a PFA (ethylene tetrafluoride-perfluoro alkyl vinyl ether copolymer) surface layer 19, with a heater 20 being placed inside the aluminum core metal member. The pressing roller 12, which has an outer diameter of 35 mm, is provided with an elastic layer 22 that is 3 mm in thickness, and made of silicone rubber formed on an aluminum core metal member 21 and a PFA surface layer 23. A nip (nip width: 7 mm) 24, which has a convex shape on the heating roller side, is formed at a press contact section between the heating roller 11 and the pressing roller 12. The device shown in FIG. 3 is further provided with a separation claw 13 used for separating a toner-fixed sheet from the heating roller 11, a cleaning web 14 used for cleaning the surface of the heating roller 11, a web roller 15 on which the cleaning web is wound and a take-up roller 16 used for winding the cleaning web up; and in this case, experiments were carried out without using fixing oil.

○: The separable/non-offset temperature range was not less than 50° C.

Δ: The separable/non-offset temperature range was from not less than 30° C. to less than 50° C.

×: The separable/non-offset temperature range was less than 30° C.

(Image Gloss Degree)

Measurements on the image gloss degree were carried out by using a gloss meter (GM-060: made by Minolta Co., Ltd.). By using a full-color printer LP-3000C (made by Seiko Epson Corp.), an unfixed image consisting of 1.5 cm×1.5 cm printed solid image (amount of adhesion: 2.0 mg/cm$^2$) was formed. This unfixed image was fixed by using a fixing device shown in FIG. 3 at a fixing temperature of 160° C.; thus, the degree of gloss was measured with respect to each of images.

The degree of gloss of not less than 30 was evaluated as ○, that from not less than 20 to less than 30 was evaluated as Δ (causing no problems in practical use), and that of less than 20 was evaluated as × (causing problems in practical use).

(High-temperature Off-set)

An unfixed image consisting of a printed half-tone image was prepared by using a full-color printer LP-3000C (made by Seiko Epson Corp.). The unfixed image was subjected to a fixing process by using a fixing device shown in FIG. 3 while the fixing temperature was successively changed by 5° C. within a range from 130° C. to 190° C., and the off-set state of each image was visually observed so that the temperature at which a high-temperature off-set occurred was evaluated. The high-temperature off-set occurring temperature of not less than 160° C. was evaluated as ○, that from not less than 155° C. to less than 160° C. was evaluated as Δ (causing no problems in practical use), and that of less than 155° C. was evaluated as × (causing problems in practical use).

(Cleaning BS (CL-BS))

By using a full-color printer LP-3000C (made by Seiko Epson Corp.), a predetermined print pattern having a B/W ratio of 6% was continuously printed under N/N environment (25° C., 45%). After the continuous printing processes of 2,000 sheets under N/N environment (after endurance printing processes), the photosensitive member and the intermediate transferring belt were visually observed and evaluated. The evaluation was made based upon the following criteria.

○: Neither filming nor black spots (BS) occurred on the photosensitive member and the intermediate transferring member, causing no problems.

Δ: Filming and BS occurred on either the photosensitive member or the intermediate transferring member; however, these were not found on copied images, causing no problems in practical use.

×: Filming and BS occurred on the photosensitive member and/or the intermediate transferring member, and these were also found on images, causing problems in practical use.

(Defective Cleaning Regulation)

Continuous copying processes were carried out in the same manner as the evaluation method of the cleaning property, and after the continuous printing processes of 2,000 sheets under N/N environment (after endurance printing processes), the state of the sleeve in the developing device and copied images were visually observed and evaluated. The evaluation was made based upon the following criteria.

○: Neither line scratches nor irregularities occurred on the sleeve.

Δ: Although line scratches and irregularities slightly occurred on the sleeve, no line scratches were found on the copied images, causing no problems in practical use.

×: A number of line scratches and irregularities occurred on the sleeve, causing problems in practical use, such as noise, toner adhesion and toner scattering.

(Toner Odor)

Tests were carried out so as to make toner odor sensory evaluation. Specifically, 3 g of toner was put into a sample glass bottle, and after having been tightly sealed, this was placed on a hot plate at 150° C., and allowed to stand still in a heated state for one hour. After one hour, this was naturally cooled, and after having been further left for one night, this was evaluated with respect to odor with the lid being opened.

○: There was an odor; however, no unpleasant feeling was given.

Δ: There was an odor, giving slightly unpleasant feeling.

×: There was an offensive odor, giving unpleasant feeling.

TABLE 6

| | Evaluation | | | | | | |
|---|---|---|---|---|---|---|---|
| | Separation upon fixing | Gloss | Offset | Heat-resistant storing property | CL-BS | CL-Regulation | Odor |
| Ex. 1 | ○ | ○ | ○ | Δ | Δ | Δ | Δ |
| Ex. 2 | ○ | ○ | ○ | Δ | Δ | Δ | Δ |
| Ex. 3 | Δ | ○ | ○ | Δ | Δ | Δ | Δ |
| Ex. 4 | ○ | Δ | ○ | Δ | Δ | Δ | Δ |
| Ex. 5 | ○ | ○ | Δ | Δ | Δ | Δ | Δ |
| Ex. 6 | ○ | ○ | ○ | Δ | Δ | Δ | Δ |
| Ex. 7 | ○ | ○ | ○ | Δ | Δ | Δ | ○ |
| Ex. 8 | Δ | ○ | ○ | Δ | Δ | Δ | Δ |
| Ex. 9 | ○ | ○ | ○ | ○ | Δ | Δ | Δ |
| Ex. 10 | ○ | ○ | ○ | ○ | ○ | ○ | ○ |
| Ex. 11 | Δ | ○ | ○ | ○ | ○ | ○ | ○ |
| Ex. 12 | ○ | ○ | ○ | Δ | Δ | Δ | Δ |
| Com. Ex. 1 | X | X | X | X | X | X | ○ |
| Com. Ex. 2 | ○ | X | X | X | X | X | Δ |
| Com. Ex. 3 | Δ | ○ | X | Δ | Δ | Δ | Δ |

(Evaluation Methods for Various Physical Properties)

<Measuring Method for Glass Transition Point (Tg)>

A differential scanning calorimeter (DSC-200: made by Seiko Instruments Inc.) was used. Specifically, 10 mg of a sample to be measured was precisely weighed, and this was put into an aluminum pan, while alumina was put into an aluminum pan so as to be used as reference, and was heated to 200° C. from normal temperature at a temperature-rise rate of 30° C./min, and this was then cooled, and subjected to measurements in the range of 20° C. to 120° C. at a temperature-rise rate of 10° C./min; thus, during this temperature-rise process, the shoulder value of the main heat-absorption peak in the range of 30° C. to 90° C. was defined as the glass transition point Tg.

<Measuring Method for Toner Softening Point (Tm)>

A sample to be measured (1.0 g) was weighed, and a flow tester (CFT-500: made by Shimadzu Corp) was used in which: measurements were made under conditions of the application of a die having a size of h 1.0 mm×ϕ1.0 mm, a temperature rise rate of 3.0° C./min, a pre-heating time of 180 seconds, a load of 30 kg, and a measuring temperature range of 60 to 140° C., and the temperature at the time of the 1/2 flow of the above-mentioned sample was defined as the resin softening point (Tm).

<Measuring Method for Acid Value>

With respect to the acid value, 10 mg of a sample was dissolved in 50 ml of toluene, and this was titrated by a solution of N/10 potassium hydroxide/alcohol that had been preliminarily set, using an mixed indicator of 0.1% of bromo-thymol blue and phenol red; thus, the value was calculated from the amount of consumption of the solution of N/10 potassium hydride/alcohol.

<Hydroxide Value of Resin>

With respect to the hydroxide value, a weighed sample was treated by acetic anhydride, and an acetyl compound thus obtained was subjected to hydrolysis so that the weight (mg) of potassium hydroxide required for neutralizing isolated acetic acid was taken.

Even when manufactured through a knead-pulverizing method, the toner of the present invention is effectively applied to an oilless fixing system. In other words, it is possible to exert superior separating property upon fixing and anti-offset property in a wide temperature range. The toner of the present invention is also superior in the image quality, cleaning property and heat-resistant storing property.

What is claimed is:

1. A toner composition, comprising a binder resin, a wax, a copolymer wax dispersant and a colorant, wherein the copolymer is a copolymer(A) of an α-olefin-maleic anhydride copolymer and a monoester of maleic acid wherein the content of maleic anhydride in the copolymer is 5 to 15% by weight with respect to all the monomers constituting the copolymer.

2. The toner composition of claim 1, wherein the copolymer is a graft copolymer formed by introducing the monoester of maleic acid into the α-olefin-maleic anhydride copolymer.

3. The toner composition of claim 1, wherein an acid value of the copolymer is 80 to 170 KOHmg/g and an ester value of the copolymer is 30 to 60 KOHmg/g.

4. The toner composition of claim 1, wherein a melting point of the copolymer is to 60 to 90° C.

5. The toner composition of claim 1, wherein the copolymer has a number-average molecular weight (Mn) of 600 to 8,000 and a value of weight-average molecular weight (Mw/number-average molecular weight (Mn) of 1.0 to 1.5.

6. The toner composition of claim 1, further comprising the copolymer in an amount of 1 to 10 parts by weight with respect to 100 parts by weight of the binder resin.

7. The toner composition of claim 6, further comprising the copolymer in an amount of 30 to 100% by weight with respect to the total content of wax.

8. The toner composition of claim 1, wherein an acid value of the binder resin is 5 to 50 KOHmg/g.

9. The toner composition of claim 1, wherein a softening point of the binder resin is 100 to 130° C.

10. The toner composition of claim 1, wherein the binder resin comprises a first polyester-based resin having a softening point of 95 to 115° C. and a second polyester-based resin having a softening point of 110 to 130° C.

11. The toner composition of claim 10, wherein a weight ratio of the first polyester-based resin and the second polyester-based resin is 40:60 to 20:80.

12. The toner composition of claim 1, further comprising the wax in an amount of 5 to 15 parts by weight with respect to 100 parts by weight of the binder resin.

13. The toner composition of claim 12, wherein the wax comprises an acid-modified wax having an acid value of 1 to 60 KOHmg/g.

14. The toner composition of claim 12, wherein the wax comprises a low melting point wax having a melting point of 70 to 100° C. and a high melting point wax having a melting point of 120 to 150° C.

15. The toner composition of claim 14, wherein the low melting point wax is a polyethylene wax and the high melting point wax is a polypropylene wax.

16. A toner composition, comprising a binder resin, a wax, a copolymer wax dispersant and a colorant;

the binder resin comprising a polyester resin, the copolymer being a copolymer of an α-olefin, maleic anhydride and a monoester of maleic acid wherein the content of maleic anhydride in the copolymer is 5 to 15% by weight with respect to all the monomers constituting the copolymer, and an acid value of the copolymer being 80 to 170 KOHmg/g and an ester value of the copolymer being 30 to 60 KOHmg/g.

17. A toner composition, comprising a binder resin, a wax, a copolymer wax dispersant, a colorant and an external additive agent, the binder resin comprising a polyester resin, the copolymer being a copolymer between an α-olefin-maleic anhydride copolymer and a monoester of maleic acid wherein the content of maleic anhydride in the copolymer is 5 to 15% by weight with respect to all the monomers constituting the copolymer, and the external additive agent comprising first inorganic fine particles having a BET specific surface area of 100 to 300 $m^2/g$ and second inorganic fine particles having a BET specific surface area of 5 to 30 $m^2/g$.

18. The toner composition of claim 17, wherein the first inorganic fine particle is silica and the second inorganic fine particle is titanate.

19. The toner composition of claim 17, wherein an amount of addition of the first inorganic fine particles is 0.3 to 3.0 weight % with respect to the toner particles and an amount of addition of the second inorganic fine particles is 0.3 to 3.0 weight % with respect to the toner particles.

20. The toner composition of claim 1, wherein an acid value of the copolymer is 80 to 170 KOHmg/g and an ester value of the copolymer is 30 to 60 KOHmg/g.

21. The toner composition of claim 1, wherein a melting point of the copolymer is 60 to 90° C.

22. The toner composition of claim 1, wherein the copolymer has a number-average molecular weight (Mn) of 600 to 8,000 and a value of weight-average molecular weight (Mw)/number-average molecular weight (Mn) of 1.0 to 1.5.

* * * * *